United States Patent [19]

McMullan

[11] 4,064,387

[45] Dec. 20, 1977

[54] HEATER CONTROL UNIT

[76] Inventor: James P. McMullan, 2630 Seaman Ave., El Monte, Calif. 91733

[21] Appl. No.: 787,296

[22] Filed: Apr. 13, 1977

[51] Int. Cl.[2] ..... H05B 3/00

[52] U.S. Cl. ..... 219/217; 5/366

[58] Field of Search ..... 219/217, 313, 501, 482, 219/506; 5/366, 370; 236/1

[56] References Cited

U.S. PATENT DOCUMENTS

| | | | |
|---|---|---|---|
| 2,403,824 | 7/1946 | Newell | 219/506 X |
| 3,585,356 | 6/1971 | Hall | 219/217 |
| 3,790,753 | 2/1974 | Miller | 219/217 |
| 3,819,905 | 6/1974 | Trostler | 219/501 |
| 3,982,098 | 9/1976 | Trostler | 219/501 |

*Primary Examiner*—C. L. Albritton

*Attorney, Agent, or Firm*—Georges A. Maxwell

[57] ABSTRACT

A remote control unit for an electric heater comprising a box-like housing with an interior partition defining a circuit board chamber and a control knob chamber. The circuit board chamber includes means to support a circuit board with a current control component having a freely projecting rotary operating shaft. The housing has openings through which electric cords, extending from a power source to the circuit board, from the circuit board to a related heater, and from the circuit board to a remote temperature sensing device, sealingly extend; a portion of the housing defining the control knob chamber is formed with a depression with a window opening; the partition is provided with an opening carrying a seal through which the shaft extends; a translucent control knob is arranged in the control knob chamber on said shaft and has a portion visibly and manually engageable in said window opening; the partition has a transparent pane at a side of the knob opposite said window and adjacent the circuit board, the circuit board is provided with a light-emitting component adjacent the window to illuminate said knob; the housing is provided with key-hole slots communicating with the control knob chamber to accommodate screw fasteners on a supporting surface whereby the unit can be releasably mounted on said surface.

10 Claims, 9 Drawing Figures

HEATER CONTROL UNIT

This invention has to do with a resistance heater control means and is more particularly concerned with a water-proof control unit for use in conjunction with waterbed heater means.

The waterbed art provides mattresses in the form of bladders established of flexible waterproof fabric or plastic sheet stock, filled with water. The water-filled mattresses are supported on a floor or horizontal platform and are retained or contained about their outside perimeters by upwardly opening rectangular frame structures which commonly include flat, vertical, transversely extending head and foot boards and elongate, flat, vertical, longitudinally extending side boards.

For practical service and comfort, the water in waterbed mattresses must be heated to temperatures which are agreeable to the users of the beds. The temperature, for practical and comfort reasons must be maintained substantially uniform at all times. To this end, the art provides heater means which commonly include flat, pad-like resistance heater units which are arranged between the mattresses and the decks or floors on which the mattresses are supported. The heater units characteristically have power cords which extend therefrom to an appropriate side of the mattresses and beneath or up and over a side board of the bed frame and thence to suitable heater control units. The heater control units are commonly simple, box-like units mounted on the side boards of the bed frame and connected with convenient power service outlets in the areas in which the beds are located by means of service cords and have temperature sensing means which include temperature sensors, such as thermometers for other functions engaged beneath the mattresses, to sense the temperatures thereof and having sensor cords extending therefrom to the control units. Finally, and in addition to the above, the box-like control units provided by the prior art have control devices with outwardly projecting shafts carrying manually engageable temperature setting or adjusting knobs.

The above noted prior art control units function to sense the temperature of the mattresses and to vary and control the supply of current to the heating units so as to automatically maintain the temperature of the mattresses or the water therein, at predetermined desired temperatures which the users select by engagement and movement of the noted operating or adjusting knobs.

The waterbed heater control units provided by the prior art, in addition to the above noted structural characteristics, include suitable circuits connected with or related to the several noted cords and the control knobs, whereby the noted function of the units is effectively attained. The various circuits which are employed by the prior art vary widely in detail. Those circuits which are in fact employed in the art are but a limited number of the numerous circuits that could be advantageously adopted and employed, if desired.

In some instances, the circuits are characterized by the use of employment of electro-mechanical devices or components while in other instances, the circuits are solid state circuits without any or with a limited number of components having mechanical or moving parts. The only mechanical components or parts which are substantially common in all control units of the class here concerned with are control units (rheostats, etc.) with rotary shafts projecting therefrom and which carry the previously noted control knobs.

Apart from the foregoing, the ordinary control units provided by the prior art involve flat, circuit boards or chassis for the circuits and box-like housings in which the chassis are suitably mounted. The housings are commonly in the form of opposing molded plastic shell sections which envelope the chassis and which are cemented or screw-fastened together. The housings have openings through which the aforementioned knob-carrying shafts project and through which the several cords of the units extend. Resilient sealing rings are commonly provided to seal about the shafts and about the cords when circumstances require.

In some instances, a heat sink must be provided within the housings to support and carry certain of the electrical components to disperse and dissipate heat in a desired manner.

While the electrical aspects or functions of the waterbed heater control units provided by the prior art are generally adequate and satisfactory, such units are often less than satisfactory from the standpoint of safety and convenience.

While the ordinary control unit circuit is provided with safety devices in the form of fuses and the like to reduce the risk of harm which occurs when such units are shorted by water spills and the like, such devices are not always effective and what should be considered to be a great risk of harm is ever-present. Further, such safety devices, while generally effective to protect the user against bodily harm, as by electrocution, are generally ineffective to protect or save the units, per se, and when such units are shorted by water spillage or the like, they are effectively destroyed and must be repaired or replaced.

A common and serious shortcoming found in ordinary waterbed heater control units provided by the prior art resides in the fact that the control knobs are substantially fully exposed and are extremely subject to being inadvertently turned so as to maladjust the temperature setting and are extremely subject to being broken or damaged.

Yet another shortcoming in the prior art control units of the character referred to above resides in the fact that the control knobs are non-illuminated and are such that they cannot be readily located and/or read at night or in the dark; requiring that the users thereof get up and turn lights on to effect adjustment of the units during the night time.

Still another shortcoming found in the prior art heater control units resides in the fact that they cannot be practically and effectively releasably fastened in place by conventional screw-fastening means. This is due to the fact that since the units are used in association with water, UL standards and other safety standards prohibit the provision of screw openings in or the engagement of electric conductive screw fasteners through the housings in which the electric circuits are arranged. While exterior screw mounting flanges, tabs and the like, might be provided on or at the exterior of such units to effect mounting thereof, such utilitarian means would be so aesthetically displeasing for use and display in bedrooms that such units would be of questionable marketability. Market surveys and the stated requirements and preferences of wholesalers and retail distributors of this class of goods indicates the foregoing to be true.

An object of my invention is to provide a waterbed heater control unit which is more water-proof or water-resistant than units of like type or class provided by the prior art and which is therefore more safe and convenient to use.

Another object of my invention is to provide a unit of the character referred to having novel and improved control knob protecting means or structure.

It is another object of the invention to provide a unit of the character referred to having safe and effective means to normally illuminate the control knob and thereby facilitate night-time reading and adjusting of the unit.

Yet another object of this invention is to provide a unit of the character referred to having novel and obscure means to facilitate easy and convenient removable mounting of the unit by means of screw fasteners on an appropriate vertical surface of a side board or other support structure.

An object and feature of this invention is to provide a unit of the general character referred to having a sectional, normally closed, compartmentalized housing, having a substantially sealed primary circuit compartment and a secondary control knob compartment with an apertured depression to provide for convenient manual engagement of the knob, at the exterior of the housing.

It is an object and feature of this invention to provide a wall of the housing defining the secondary compartment with screw fastener engaging keyhole slots to facilitate releasably mounting the unit on a support structure in which slot engaging mounting screws can be conveniently engaged.

Yet another object of this invention is to provide the keyhole slots in the secondary compartment of the housing whereby said slots establish drain openings for the said compartment to effect draining of water, intruding that compartment, therefrom.

Still another object and feature of the present invention is to provide a structure of the character referred to wherein the compartments are defined and separated by a partition within the housing; said partition has an aperture with an annular sealing means therein through which a knob supporting shaft of a circuit compartment is sealingly engaged.

It is an object and feature of this invention to provide a control knob which is translucent or transparent; to provide a transparent window in the partition adjacent to the knob; and to provide a light emitting component in the circuit arranged in the primary compartment adjacent said window whereby the knob is normally and effectively illuminated for night viewing of said knob.

Other objects and features of this invention include improved journal support means for the control knob; novel sealing means between the sections of the housing; and improved means and/or structure to prevent the entry of water into the primary circuit compartment of the housing.

The foregoing and other objects and features of my invention will be fully understood from the following detailed description of one typical preferred form and application of the invention, throughout which description reference is made to the accompanying drawings in which:

FIG. 7 is a view of a portion of the structure and taken substantially as indicated by line 7—7 on FIG. 2;

Figure 1:
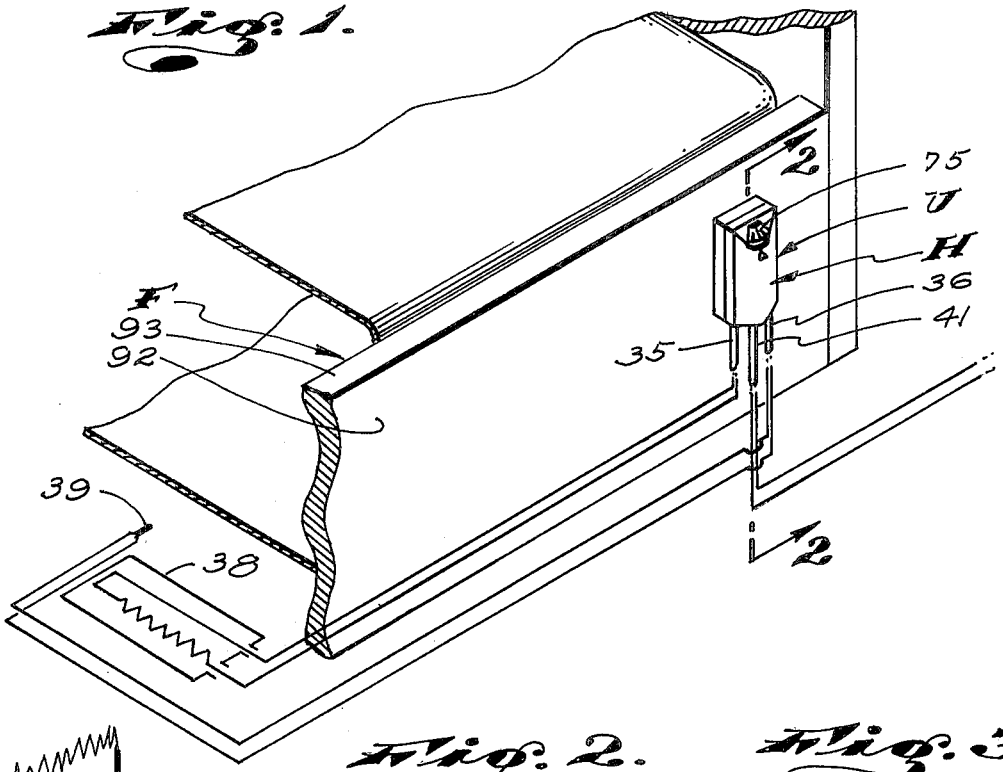
FIG. 1 is an isometric view of a portion of a waterbed structure with my control unit related thereto.
Figure 2:
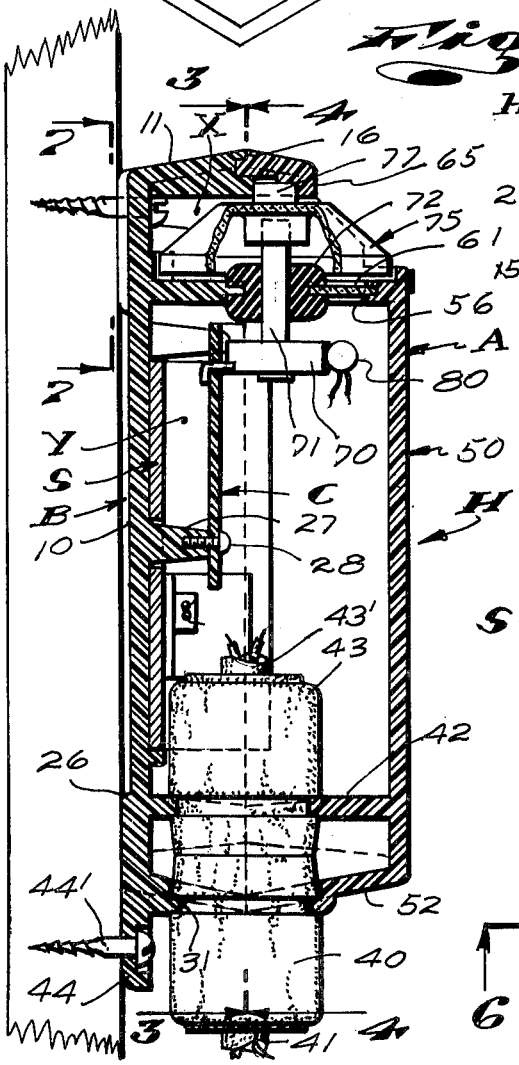
FIG. 2 is an enlarged detailed sectional view taken substantially as indicated by line 2—2 on FIG. 1.
Figure 3:
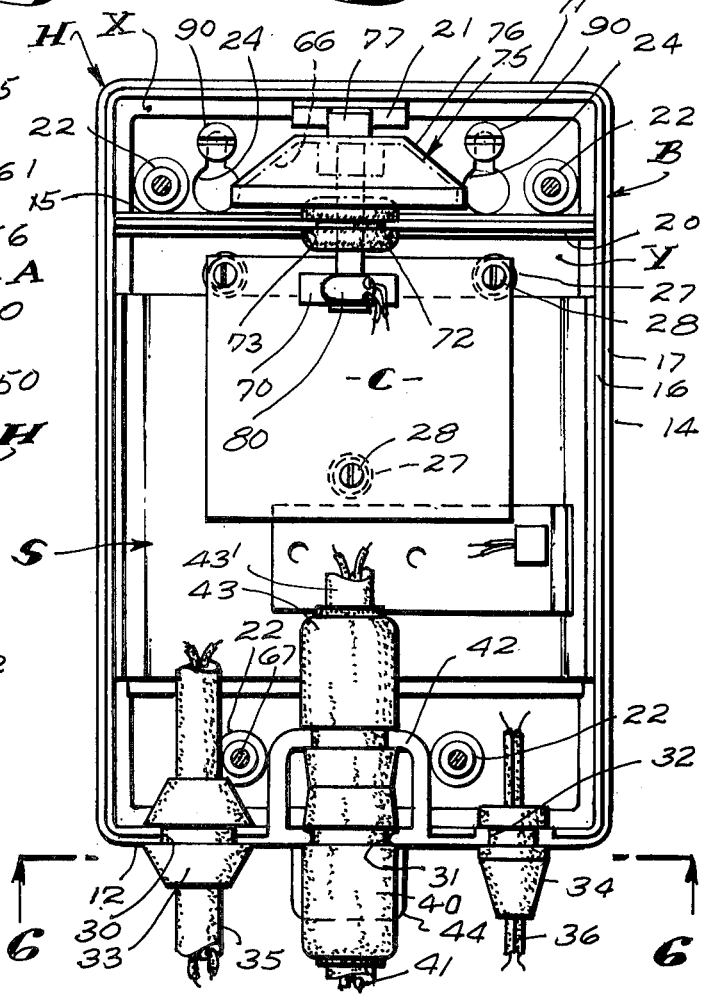
FIG. 3 is a view taken substantially as indicated by line 3—3 on FIG. 2.
Figure 4:
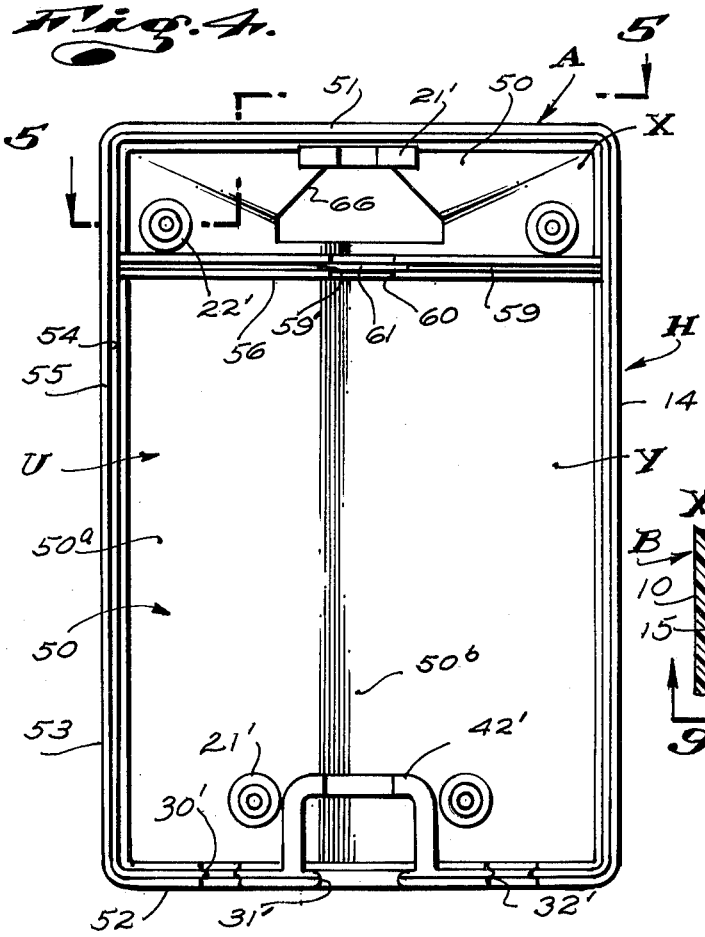
FIG. 4 is a view taken substantially as indicated by line 4—4 on FIG. 2.
Figure 2:
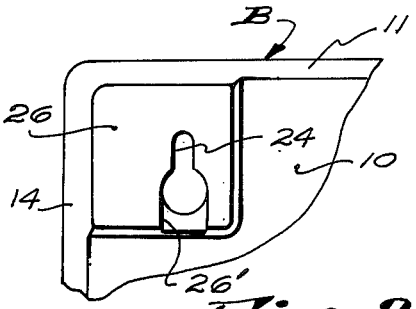
Figure 8:
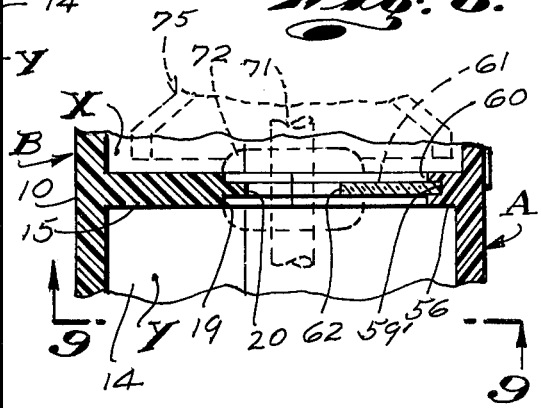
FIG. 8 is an enlarged detailed view of a portion of the structure shown on FIG. 2 with certain parts in dotted lines to better illustrate the construction.
Figure 5:
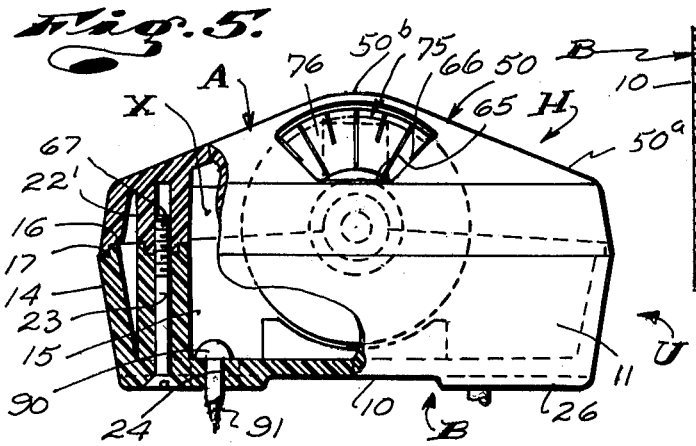
FIG. 5 is a view taken substantially as indicated by line 5—5 on FIG. 4.
Figure 9:
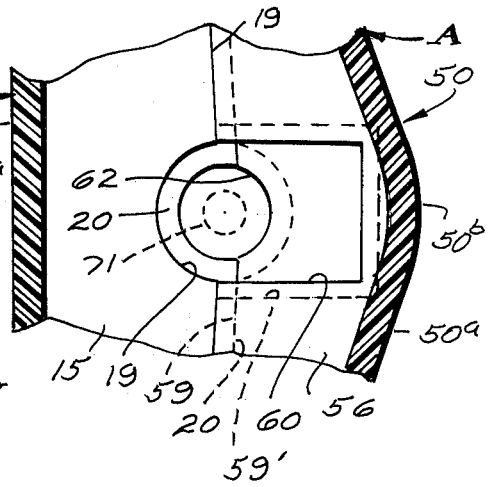
FIG. 9 is a sectional view taken substantially as indicated by line 9—9 on FIG. 8.
Figure 6:
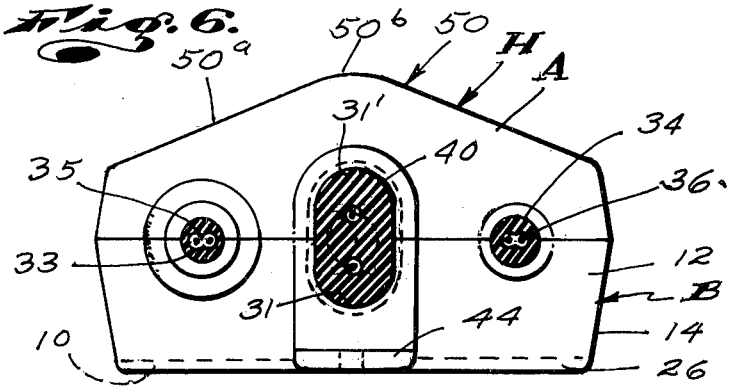
FIG. 6 is a view taken substantially as indicated by line 6—6 on FIG. 3.

The waterbed heater control unit U that I provide and which is illustrated in the accompanying drawings includes an elongate rectalinear box-like housing H which is particularly adapted and suitable for arrangement in two positions; one position being a horizontal position for free supported engagement on a horizontal surface and the other being a vertical position for releasable securement of the unit on and/or adjacent to a vertical support surface.

For the purpose of this disclosure, I have illustrated the unit in the above noted second or vertical position and will orient and describe the structural features of the invention accordingly. It is to be understood that in practice, the structure can be disposed in the other noted horizontal position, if desired.

The unit U here provided includes an elongate, vertical, box-like housing H having front and rear opposing shell-like sections A and B. The sections A and B are preferably molded of a suitable plastic material.

The rear section B of the housing H has a substantially flat, vertical rear wall 10, flat horizontal top and bottom walls 11 and 12 projecting forwardly from the upper and lower ends of the rear wall 10, flat, substantially forwardly projecting side walls 14 extending vertically along and forwardly from the sides of the rear wall and joined with the ends of the top and bottom walls.

The section B next includes a flat, horizontal, forwardly projecting laterally extending partition 15 in its upper portion, dividing the interior of the forwardly opening section into upper and lower, primary and secondary sub-compartments.

The forward edges 16 of the intersecting top, bottom and side walls of the section B are provided with a forwardly and laterally outwardly opening sealing seat 17. The seat 17 extends substantially continuously about the perimeter of the section B and is only interrupted at or along the lower edge of the bottom wall 12 to accommodate portions of the several electric cords, as will hereinafter be described.

The forward edge 18 of the partition 15 has laterally inwardly and forwardly inclined opposing side portions which extend laterally inwardly from the forward edges of the opposite side walls and which terminate at a central, forwardly opening semi-circular seal engaging notch or seat 19 in the partition. The edges 18 and seat 19 are provided with a central sealing flange 20, which flange is uninterrupted and coextensive with the noted forward edges 18 and the seal engaging notch 19.

The top wall 11 of the section B is provided with a forwardly projecting protruberance or journal box 21 at its lower or inside surface, which protruberance or block has a semi-circular bearing seat which is spaced above and in axial alignment with the notch 19 in the partition.

The upper portion of the rear wall 10 defining the rear surface or wall of the upper secondary sub-chamber in the section B is provided with a pair of laterally spaced, forwardly projecting, coupling posts 22 with central screw fastener receiving through openings 23, opening forwardly and rearwardly of the section B.

The above noted upper portion of the rear wall 10 is also provided with a pair of laterally spaced through keyhole slots 24, the large diameter portions of which are substantially tangential with the upper or top surface of the partition 15 and the small diameter or neck portions of which extend or occur above and at the top of the large diameter portions of said keyhole slots.

In the preferred carrying out of the invention and as shown in the drawings, the rear surface of the rear wall 10, at its upper portion in which the slots 24 are formed and from which the posts 22 project, is provided with laterally spaced rearwardly projecting, substantially square mounting pads 26. The pads 26 increase the wall thickness and strength of the section B in a desired manner and also serve to maintain the rear surface of the rear wall spaced from a related supporting surface, whereby irregularities in the supporting surface are less likely to interfere with the effective mounting or supporting of the unit and whereby sufficient distance and space is provided between the rear wall and its supporting surface to assure and allow for the flow of cooling air between and the flow and drainage of water that might find its way between the housing and its related supporting surface. In practice, the pads 26 are relieved as at 26', below the slots 24 so as to allow water that might flow outwardly and rearwardly in and from the slots to drain freely therefrom. In addition, the relief allows cooling air to circulate into and out of the chamber X.

The portion of the rear wall 10 below the partition 15 is provided with a plurality (three) of suitably positioned forwardly projecting chassis mounting posts 27. The posts 27 support a flat plate-like circuit board C, which circuit board is secured to the posts by means of screw fasteners 28 in accordance with common practice and as shown in the drawings.

In the lower end of the section B, I provide a second pair of laterally spaced forwardly projecting coupling posts 22 similar to the posts 22 in the upper portion of the section B and described above.

The bottom wall 12 of the section B is provided with three laterally spaced vertical and forwardly opening electric cord accommodating notches 30, 31 and 32, opening at the forward edge of said wall. The outside notches 30 and 32 are adapted to cooperatively receive and engage about one-half of enlarged, grooved, rubber or rubber-like resilient retaining grommets 33 and 34 on power and temperature sensor cables or cords 35 and 36 which extend downwardly from within the housing, through the lower or bottom wall thereof and thence extend to a related heating pad 38 and temperature sensor 39, as diagrammatically illustrated in FIG. 1 of the drawings.

The other or central notch 31 in the bottom wall 12 is adapted to cooperatively receive and releasably engage about one-half of a resilient, grooved first service plug member 40 at the end of a power service cord 41 extending from a power service outlet (not shown) to the unit.

Within the section B, above and at opposite sides of the notch 31 are the rear portions of top and side walls of an internal receptacle box 42 formed integrally in the housing to accommodate and support a second power service plug member 43 which mates with the first plug member 41. The member 43 is grooved and the central portion of the top wall of the box 42 is notched to engage in and about one-half of the groove in the member 43 so as to retain the member 43 in proper, fixed position in the box for easy and convenient mating with the member 40 on the cord 41. The member 43 has conductors 43' extending upwardly from it to connect with components (not shown) of the circuit which is carried by the circuit-board C.

The lower rear end portion of the rear wall can be provided with mounting pads similar to the pads 26 at the upper portion of the rear wall and described above or can, as shown, be provided with a single laterally extending pad 26', which pad or pads serve the same end as do the pads 26.

Finally, the section B can, as shown, be provided with a central depending aperture screw-receiving mounting tongue 44 to facilitate securing the unit in mounted engagement relative to a mounting surface should such securing of the unit be desired. It is to be noted that the tongue 44 is arranged to occur rearward of and is obscured by the removable plug member 40. Access to the tongue 44 to facilitate the engagement and/or removal of a screw fastener 44' therewith is facilitated by simply removing or temporarily disengaging the plug member 40 from the member 43 and the housing, for that purpose.

The front section A of the housing H, like the rear section B, is a molded plastic shell-like section and is normally arranged to open rearwardly in opposing and closed relationship with the section B.

The section A has a front wall 50 characterized by a pair of flat vertically extending laterally inwardly and forwardly converging, inclined, side portions 50$^a$ defining a central vertically extending central ridge 50$^b$ and a flat, laterally extending, forwardly and downwardly inclined top portion defining a forwardly and upwardly disposed, inclined substantially triangular facet 50$^c$ at and across the upper end portion of the front wall.

The section A next includes flat, top, bottom and side walls 51, 52 and 53 about and projecting substantially rearwardly from the perimeter of the front wall and defining a rearwardly disposed rim or edge 54 about the section A which normally opposes and cooperatively engages the front edge 16 on the section B. The rear edge 54 has a rearwardly projecting flange 55 about its outer portion, which flange normally projects into and establishes seated sealing engagement in the seat 17 in and about the forward edge 16 of the section B.

The section A next includes a flat horizontal transversely extending partition 56 within its upper portion on the same horizontal plane as the partition 15 in the section B, and having laterally inwardly and forwardly convergent rear edges to normally establish flat opposing engagement with the similarly inclined edges on the partition 15. The noted rear edges of the partition 56 are provided with central longitudinal grooves 59 in which the flanges 20 on the edges 18 of the partition 15 are normally engaged in sealing relationship.

The partition 56 has a central vertically and rearwardly opening rectangular notch 60 equal in lateral extent with the diameter of the semi-circular notch or seat in the center of the partition 15 and which is normally in register therewith. The notch 60 is substantially greater in fore and aft dimension than in lateral extent and a groove 59' which is a continuation of the grooves 59 extends about the perimeter of the notch.

Within the notch 60 and sealingly engaged in the groove 59' is a transparent plastic panel or light-transmitting pane 61. The pane 61 has a notched or rearwardly disposed semi-circular rear edge 62, the center of which is concentric with the central notch or seat 19 in the partition 15. The pane 61 is equal in thickness with the flange 20 on partition 15 and is such that the semi-circular rear edge portion thereof normally establishes a semi-circular or radiused continuation or extension of the semi-circular portion of the flange 20 which occurs in the seat 19 to cooperate therewith and define what is in effect and can be best termed a circular retaining and sealing flange within the opening established by the seat 19 and notch 62 in the partition structure and pane, within the housing.

The pane 61 can be press-fitted or can be fixed and sealed in the notch 60 by a suitable cement.

The partition 56 divides the interior of section A into a lower sub-compartment and an upper sub-compartment, which sub-compartments normally cooperate with the related upper and lower sub-compartments of the section B to define complete or full upper and lower compartments X and Y within the housing structure.

The central portion of the upper wall portion or facet 50c of the front wall 50 is provided with a downwardly extending quadrant shaped depression 65 spaced above and concentric with the axis of the noted opening and circular retaining flange in the partition structure. The lower or bottom end of the depression 65 is open and establishes a vertically opening quadrant shaped window 66 in the top or upper portion of the housing and in inward recessed relationship with the forwardly and upwardly disposed faceted end of the housing.

The top wall 51 of section A has a journal block 21' with a rearwardly opening vertically extending semi-circular bearing seat which normally opposes and cooperates with the journal block 21 of the section B to define a circular vertically extending downwardly opening journal or bearing opening within the upper end or top of the housing.

The section A is next provided with a plurality of free standing coupling posts 22' with internally threaded rearwardly opening central fastener receiving openings. The posts are formed integrally on and project rearwardly from the front wall 50 of the section B in axial alignment with related coupling posts 22 of or on the section B. The posts 22 and 22' have flat normally opposing free ends. In the preferred carrying out of the invention, and as illustrated, the free ends of the posts 22 have forwardly opening central sockets and the free ends of the posts 22' have rearwardly projecting pins which enter the sockets, whereby a more stable and sealed relationship is established between the related posts.

The sections A and B are releasably secured together by screw fasteners 67 engaged through the posts 22 from the rear of the housing and which extend into threaded engagement in the posts 22', as clearly illustrated in the drawings.

The bottom wall 52 of the housing section A is provided with three laterally spaced vertically and rearwardly opening electic cord accommodating notches 30', 31' and 32', which open at the rear edge of the section A and which normally register with the notches 30, 31 and 32 in the bottom wall of the section B. The outer notches 30' and 32' are adapted to and normally cooperatively receive and engage about the other half of the enlarged, grooved, rubber or rubber-like resilient grommets 33 and 34 on the power and temperature sensor cords 35 and 36, as clearly illustrated in the drawings.

The other or central notch 31' registers with the notch 31 and is adapted to cooperatively receive and releasably engage about the other half of the first, resilient, grooves, service plug member 40, as illustrated.

The section A, like the section B, is provided with a central, rearwardly opening receptacle box structure 42' which normally registers with and opposes the receptacle box structure 42 in the section B and which accommodates the second power service plug member 43, as shown in the drawings. The box 42' has a top wall which is notched to accommodate and which engages in that half of the groove in the second member 43, which is not engaged in and by the corresponding notched top wall of the box 42 in section B.

The flat plate-like circuit board C supported by the posts 27 in the chamber Y of the housing has a forwardly disposed flat surface on which elements, parts and/or components of the electric circuit which is employed are suitably mounted and from which said elements, parts and components project. One part of the circuit employed is a manually operable current changing device 70, such as a potentiometer or rheostat, and which has an elongate rotary shaft 71 projecting therefrom. The device 70 is fixed to the board C to project forwardly thereform, below and in axial alignment with the opening and annular flange in the partition structure and the bearing opening defined by the related journal blocks in the top of the upper compartment X and with the shaft 71 thereof projecting upwardly therefrom and freely through said opening in the partition structure and into the compartment X of the housing.

Within the opening in the partition structure, in sealing engagement with the annular flange within that opening and in sliding sealing engagement about the shaft 71 is an annular rubber grommet type sealing ring 72 with a radially outwardly opening groove 73 in which said flange is engaged.

Within the upper compartment X and engaged on the shaft 71 is a round or substantially disc-shaped operating knob 75. The knob 75 has an upwardly convergent truncated conical side wall 76 with suitable calibrations formed or applied thereto, a flat, top wall with a central cylindrical, tubular, hub 77 projecting upwardly into rotary bearing engagement in the opening established by the journal blocks and into the lower open end of which the shaft 71 extends and establishes driving rotary engagement.

The knob 75 can, as shown, have an annular depending skirt portion about the lower edge of the truncated side wall 76.

The knob 75 is of substantial diametric extent and is so shaped and/or proportioned that a quadrant portion thereof projects freely through the quadrant shaped window 66 in the forwardly and upwardly opening depression 65 in the upper, inclined faceted wall portion 50c of the section A, to occur freely within the confines of the depression 65 where it is clearly visible and is readily manually engageable.

The manually engageable quadrant portion of the knob occurs inside or within the outside plane of the housing and is therefore substantially protected from inadvertent engagement and which might affect adjustment of the circuit and/or damage the knob and its related structure.

Further, the shell-like knob 75 opens downwardly and overlies the transparent pane 60 in the partition structure.

The circuit on the board C includes a light emitter 80 such as a neon tube. The emitter 80 is positioned and mounted in suitable and close position below the pane 60 so that light emitted thereby is free to pass up through the pane into the interior of the knob and to thereby effectively illuminate the knob for easy and convenient locating and reading of the knob and the calibrations thereon, at night or in the dark.

The heat sink S, if the circuit employed requires such a component, is a flat metal plate arranged adjacent the front surface of the rear wall of the section B, within the chain compartment Y, and has forwardly turned vertically extending side flanges which project forwardly in the opposite side portions of the compartment and to such an extent that they are normally engaged by the front section A of the housing, to retain the heat sink in position against the rear wall.

It will be apparent and is to be understood that the conductors of the cords 35 and 36 and the conductors 43' related to the second plug member 43 are exposed within the compartment Y and extend and are suitably connected with related components of the control circuit which is carried by the board C and/or heat sink S.

With the structure illustrated in the drawings and described above, it will be apparent that the invention provides an elongate vertical box-like housing having top, bottom, front, rear and side walls and a partition dividing the interior of the housing into upper and lower compartments X and Y.

The housing has posts projecting freely into the interior of the compartment Y and on which the board C, carrying the control circuit, is suitably mounted. The bottom wall has downwardly disposed vertical openings through which required conductor cables freely extend and in which resilient, grooved sealing and retaining grommets, carried by the cables, are sealingly engaged. The lower end portion of the housing is also provided with a junction box structure communicating with an access opening with the bottom wall through which a first power service plug member, at the end of a power service cord, is normally engaged, which junction box has an opening communicating with the chamber Y and in which a complimentary second service plug member 43, with conductors extending to the circuit within the chamber Y, is held or retained for convenient engagement by and/or with the said first plug member.

The housing is split or divided on a central vertical plane between the front and rear walls to define front and rear sections with opposing edges formed with interengageable sealing means. The sections have axially aligned coupling posts with opposing interengaging orienting and sealing means at their free ends and in and through which screw fasteners are engaged to releasably retain the sections together.

The upper forward portion of the housing has a forwardly and upwardly opening depression with a forwardly and upwardly opening window. The window has an upwardly disposed quadrant portion and truncated triangular rear portion.

The rear wall of the housing has laterally spaced drain openings communicating with the upper compartment X and which occur tangential with the partition within the housing whereby water entering the upper compartment through said window is free to drain from said compartment.

The drain openings are keyhole slots, having neck portions of reduced dimension extending upwardly from the lower drain opening portions thereof. The lower drain opening portions of the keyhole slots are such that they will freely pass the enlarged heads 90 of screw fasteners 91 projecting from a supporting surface 92, such as the outside surface of a side rail 93 of a related waterbed frame F. The upper, reduced, neck portions of the keyhole slots are such that they will accommodate the shank of the noted screw fasteners but will not pass the heads thereof. With this relationship of parts, the housing can be moved rearwardly toward the support surface 92 so that the fastener heads 90 move through the lower portions of the keyhole slots and can then be shifted downwardly to move the shanks of the said fasteners into engagement with the upper neck portions of the slots and such that the fastener heads releasably retain the housing on the rail 93 with its rear wall in flat juxtaposition with the surface 92 of that rail.

If it is desired to more securely or permanently secure and fix the housing on the rail or adjacent the supporting surface 92, the aforementioned fastener 44' can be engaged through the apertured tongue 44 provided at the lower end of the housing and into the rail or structure defining the supporting surface.

The structure here provided is next characterized by a central vertical opening in the partition, a current altering circuit component with an elongate rotary shaft carried by the chassis and arranged with its shaft projecting upwardly through the opening in the partition into the upper compartment X and by sealing means in the opening in the partition, about the shaft. The shaft carries a shell-like upwardly convergent truncated conical control knob, the major portion of which occurs within the upper compartment X and a quadrant portion of which projects freely through the window opening in and into the confines of the upwardly and forwardly opening depression or recess in the upper forward portion of the housing where it is clearly visible and conveniently manually engageable.

The knob is provided with a central upwardly projecting trunion rotatably supported in a journal block within the top of the housing whereby the knob is supported and held against radial displacement which is likely to adversely deflect its related shaft and cause the seal in the partition and about the shaft to fail.

Finally, the knob is transparent or translucent, the partition is provided with a transparent or translucent pane below the knob and the circuit on the circuitboard carries a light-emitting component below the pane whereby the knob is illuminated for easy and convenient locating and reading of the knob in the dark.

The rear wall of the housing is provided with pads to support the housing in spaced relationship from a related horizontal or vertical supporting surface whereby water is not subject to being trapped or retained between the housing and the supporting surface and so that cooling air is free to circulate therebetween.

With the structure here provided, the unit, as a whole, whether in a vertical disposition, as described above, or arranged in its alternate horizontal position where the rear wall of the housing becomes the bottom wall, volumes of water (of one or more gallons) have been repeatedly poured and/or directed onto and over the housing at various rates and under differing pressures without any failure of the several sealing means employed and resulting shorting of the circuit within the housing. Such performance far exceeds present UL standards for like units or devices, which standards require that such units withstand a single drenching with one gallon of water, without shorting. It is understood and believed that the above noted, present UL standard was established by the best expected performance of the most effective and satisfactory waterbed heater control units provided by the prior art and which are commercially available.

Having described only typical form and application of my invention, I do not wish to be limited to the specific details herein set forth, but wish to reserve to myself any modifications and/or variations which may appear to those skilled in the art and which fall within the scope of the following claims.

Having described my invention, I claim:

1. A waterbed heater control unit comprising an elongate, vertical, rectalinear box-like housing having front, rear, top, bottom and side walls and a horizontal transverse partition within the housing defining upper and lower compartments and having a central vertical opening, a circuit board mounted within the lower chamber carrying an electric control circuit for a related electric resistance heater, adjustable to select a desired heater heat output and operable to automatically control a supply of current to a related heater whereby selected heat output is attained, said circuit includes an electric current altering device with an elongate rotatable shaft extending vertically upwardly through the opening in the partition, sealing means in said opening and about said shaft, a window opening in the housing accessible at the front thereof communicating with the upper compartment, a control knob on the shaft within said upper compartment and having a portion projecting into the window and manually accessible at the front of the housing, cord receiving openings in a wall of the housing, electric cords and cables connected with the circuit, a remote power source, a remote temperature sensor junction and a remote related heater extending through the cord receiving openings.

2. The structure set forth in claim 1 wherein said rear wall has laterally spaced drain openings adjacent the partition and communicating with the upper chamber whereby water entering the upper chamber through said window drains freely therefrom through said drain openings.

3. The structure set forth in claim 1 wherein the drain openings are the lower large diameter screw fastener head receiving portions of vertically extending keyhole slots having elongate screw fastener shank receiving upper slot portions, said slot portions cooperatively receiving and engaging the heads and the shanks of spaced screw fasteners engaged in and projecting from a vertical surface of a supporting structure opposing and adjacent to the rear wall and releasably mounting the housing on said structure.

4. The structure set forth in claim 2 wherein the control knob is a substantially disc-shaped translucent part adjacent to and overlying the top of the partition, the partition has a transparent pane and said circuit has a light emitting component below and substantially adjacent to said pane whereby said knob is illuminated.

5. The structure set forth in claim 3 wherein the control knob is a substantially disc-shaped translucent part adjacent to and overlying the top of the partition, the partition has a transparent pane and said circuit has a light emitting component below and substantially adjacent to said pane whereby said knob is illuminated.

6. The structure set forth in claim 1 wherein the control knob is a substantially disc-shaped translucent part adjacent to and overlying the top of the partition, the partition has a transparent pane and said circuit has a light emitting component below and substantially adjacent to said pane whereby said knob is illuminated.

7. The structure set forth in claim 1 wherein said housing is split vertically on a plane substantially parallel with and between the front and rear walls and defines a forwardly opening shell-like rear section with forwardly disposed edges about its portions of the paritition, top, bottom and side walls and a rearwardly opening shell-like front section with rearwardly disposed edges about its portions of the partition, top, bottom and side walls, said edges of said sections having interengageable sealing means, said rear section having a plurality of coupling posts with screw fastener receiving openings projecting forwardly from the rear wall, said front section having a plurality of coupling posts with screw fastener receiving openings projecting rearwardly from the front wall in axial alignment with related posts on the rear section, and screw fasteners engaged in and between the aligned posts.

8. The structure set forth in claim 5 wherein the sealing means between the sections includes rearwardly projecting sealing flanges along said edges of the front section and forwardly opening sealing channels along said edges of the rear section and cooperatively receiving the sealing flanges.

9. The structure set forth in claim 1 wherein said front wall has laterally inwardly and forwardly inclined side portions defining a central vertical forward ridge and an upwardly and rearwardly inclined upper end portion defining a forwardly and upwardly inclined substantially triangular facet, said upper portion of the front wall has a forwardly and upwardly opening recess with open quadrant shaped lower portion and an open truncated forwardly converged rear portion defining said window, said knob having a rear cylindrical portion extending into said quadrant portion and an upwardly and radially inwardly conical portion extending through said rear portion of the window and into the confines of the recess.

10. The structure set forth in claim 9 wherein the knob has a central upwardly projecting cylindrical trunion and said top wall of the housing has a journal block within the upper compartment rotatably supporting the trunion.

* * * * *